US009207571B2

(12) United States Patent
Eto et al.

(10) Patent No.: US 9,207,571 B2
(45) Date of Patent: Dec. 8, 2015

(54) IMAGE FORMING APPARATUS AND TONER CASE

(71) Applicant: KYOCERA DOCUMENT SOLUTIONS, Osaka-shi (JP)

(72) Inventors: Daisuke Eto, Osaka (JP); Koji Tanio, Osaka (JP)

(73) Assignee: KYOCERA DOCUMENT SOLUTIONS INC., Osaka-Shi, Osaka (JP)

( * ) Notice: Subject to any disclaimer, the term of this patent is extended or adjusted under 35 U.S.C. 154(b) by 0 days.

(21) Appl. No.: 14/375,422

(22) PCT Filed: Jan. 22, 2013

(86) PCT No.: PCT/JP2013/051223
§ 371 (c)(1),
(2) Date: Jul. 29, 2014

(87) PCT Pub. No.: WO2013/115014
PCT Pub. Date: Aug. 8, 2013

(65) Prior Publication Data

US 2015/0030355 A1 Jan. 29, 2015

(30) Foreign Application Priority Data

Jan. 31, 2012 (JP) ..... 2012-019166
Feb. 3, 2012 (JP) ..... 2012-021646

(51) Int. Cl.
*G03G 15/08* (2006.01)

(52) U.S. Cl.
CPC ..... *G03G 15/0865* (2013.01); *G03G 15/0886* (2013.01)

(58) Field of Classification Search
CPC ..... G03G 15/0865; G03G 15/0886; G03G 2215/067; G03G 2215/0692
See application file for complete search history.

(56) References Cited

U.S. PATENT DOCUMENTS 5,419,468 A * 5/1995 Taki ..... 222/554
7,742,724 B2 6/2010 Tazawa et al.

(Continued)

FOREIGN PATENT DOCUMENTS

JP H06-035322 A 2/1994
JP 2000-098724 A 7/2000

(Continued)

OTHER PUBLICATIONS

Notice of Reasons for Rejection issued to corresponding JP Application No. 2012-021646, mailed Jan. 7, 2014.

(Continued)

*Primary Examiner* — Rodney Bonnette
(74) *Attorney, Agent, or Firm* — Knobbe Martens Olson & Bear LLP

(57) ABSTRACT

This image formation device is provided with a toner case (6), a developer body (83) and a developer (12). The toner case (6) includes a case body (22) having a discharge port (35), and a case-side shutter (28) for opening and closing the discharge port (35). A replenishing port (88) for accepting the toner is provided to the developer body (83). The developer (12) includes a developer-side shutter (98) for opening and closing the replenishing port (88). When the toner case (6) has been mounted on the developer (12) and the case-side shutter (28) is displaced from a position where the discharge port (35) is closed to a position where the discharge port (35) is open, the case-side shutter (28) pushes and displaces the developer-side shutter (98) from a position where the replenishing port (88) is closed to a position where the replenishing port (88) is open.

7 Claims, 15 Drawing Sheets

(56) References Cited

U.S. PATENT DOCUMENTS

| | | | | |
|---|---|---|---|---|
| 7,747,198 | B2 | 6/2010 | Nakagami | |
| 9,008,555 | B2 * | 4/2015 | Eto | 399/263 |
| 2007/0196136 | A1 | 8/2007 | Nakagami et al. | |
| 2007/0212118 | A1 | 9/2007 | Nagae et al. | |
| 2007/0237551 | A1 * | 10/2007 | Kawai | 399/258 |
| 2008/0181661 | A1 * | 7/2008 | Mase et al. | 399/120 |
| 2008/0199224 | A1 | 8/2008 | Isomura et al. | |
| 2010/0067957 | A1 | 3/2010 | Tazawa et al. | |
| 2011/0052266 | A1 * | 3/2011 | Yoon et al. | 399/258 |
| 2013/0195511 | A1 * | 8/2013 | Eto | 399/260 |
| 2013/0279943 | A1 * | 10/2013 | Wakimoto | 399/262 |
| 2013/0315633 | A1 * | 11/2013 | Tanio | 399/258 |
| 2013/0322925 | A1 * | 12/2013 | Fujii | 399/258 |

FOREIGN PATENT DOCUMENTS

| | | | |
|---|---|---|---|
| JP | 2005-134452 | A | 5/2005 |
| JP | 2006-078767 | A | 3/2006 |
| JP | 2006-139067 | A | 6/2006 |
| JP | 2006-309147 | A | 11/2006 |
| JP | 2007-219417 | A | 8/2007 |
| JP | 2008-129561 | A | 6/2008 |
| JP | 2008-185827 | A | 8/2008 |
| JP | 2008-233862 | A | 10/2008 |
| JP | 2009-042567 | A | 2/2009 |
| JP | 2009-098409 | A | 5/2009 |

OTHER PUBLICATIONS

Notice of Reasons for Rejection issued to corresponding JP Application No. 2012-021646, mailed Jul. 1, 2014.

Notice of Reasons for Rejection issued to corresponding JP Application No. 2012-021646, mailed Feb. 3, 2015.

Notice of Reasons for Rejection issued to corresponding JP Application No. 2012-019166, mailed Jan. 7, 2014.

* cited by examiner

IMAGE FORMING APPARATUS AND TONER CASE

CROSS-REFERENCE TO RELATED APPLICATIONS

This application is the U.S. National Phase under 35. U.S.C. §371 of International Application PCT/JP2013/051223, filed Jan. 22, 2013, which claims priority to Japanese Patent Application No. 2012-019166, filed Jan. 31, 2012 and Japanese Patent Application No. 2012-021646, filed Feb. 3, 2012. The disclosures of the above-described applications are hereby incorporated by reference in their entirety. The International Application was published under PCT Article 21(2) in a language other than English.

TECHNICAL FIELD

The present invention relates to an image forming apparatus and a toner case provided in the image forming apparatus.

BACKGROUND ART

Conventionally, an image forming apparatus employing xerography performs a developing process by supplying toner from a developer to an electrostatic latent image formed on a surface of a photosensitive drum or the like. The toner used in such a developing process is supplied from a toner case such as a toner container, an intermediate hopper and the like to the developer. The toner case is detachably mounted to the developer. For this reason, the developer is provided with a replenishing port. The replenishing port is provided in order to receive the toner from the toner case. The replenishing port is generally covered by a shutter (hereinafter referred to as "developer-side shutter") that can be opened and closed (refer to Patent Document 1).

In addition, the toner case is provided with a case body that houses the toner. The case body is provided with a discharge port for discharging the toner to the developer.

A configurational example of the above-described developer-side shutter is shown in FIG. 15. As shown in FIG. 15, a developer-side shutter 121 is provided with a tilted face 122 that is directed obliquely upward. The developer-side shutter 121 has a substantially triangle shape in a side view. The developer-side shutter 121 is linearly slidable between a position where the replenishing port 124 is closed (see a dashed-two-dotted line) and a position where the replenishing port is open (see a solid line). The replenishing port 124 is provided in the developer 123. In a state in which the toner case (not illustrated) is not mounted to the developer 123, the developer-side shutter 121 is biased by a pair of coil springs 125 toward the position where the replenishing port 124 is closed. The pair of coil springs 125 is provided on both sides of the replenishing port 124.

In this state, if the toner case (not illustrated) is mounted to the developer 123 from an upper side as shown by an arrow in FIG. 15, the toner case presses the tilted face 122 of the developer-side shutter 121 from an upper side. And then, the developer-side shutter 121 slides linearly from the position where the replenishing port 124 is closed to the position where the replenishing port 124 is open. In other words, in such a technique, the developer-side shutter 121 is displaced in conjunction with an act of mounting the toner case to the developer 123.

In addition, a discharge port of the toner case is generally covered by a shutter that can be opened and closed. For example, Patent Document 2 discloses a toner case that is provided with a rotatable lever and a shutter that rotates according to rotation of the lever to open and close the discharge port. In addition, a gear is provided on a lever side and a shutter side, respectively. By engaging these gears the rotation of the lever is transmitted to the shutter (refer to Patent Document 2).

In the toner case thus configured, a position where the lever-side gear and the shutter-side gear engage with each other may vary due to errors in component sizes and assembling. In addition, a reaction force in directions separating from each other is applied to the position where the lever-side gear and the shutter-side gear engage with each other. This may make rotation of the lever and the shutter non-smooth, and cause tooth skipping of the gear. For solving such problems, a configuration in which thicknesses of the lever and the shutter are increased, as well as a configuration in which a cover for covering a fulcrum point of rotation of the lever and shutter is separately provided have been known.

Patent Document 1: Japanese Unexamined Patent Application Publication No. 2005-134452

Patent Document 2: Japanese Unexamined Patent Application Publication No. 2006-309147

DISCLOSURE OF THE INVENTION

Problems to be Solved by the Invention

However, upon mounting the toner case to the developer, when the tilted face of the developer-side shutter is pressed by the toner case from an upper side, the toner case tends to move up due to the reaction force of the developer-side shutter pushing the toner case away. Operators such as a user, a service person, or the like are thus required to press the toner case downward with a force that is greater than the above-described moving up force. As a result, a substantial force has been required in a process of mounting the toner case to the developer.

Furthermore, in a configuration in which thicknesses of the lever and the shutter are increased, additional materials and therefore additional cost are required for forming the lever and the shutter. Also in a configuration in which a cover for covering a fulcrum point of rotation of the lever and shutter is separately provided, a greater number of parts and therefore additional cost are required.

Taking the above discussed circumstances into consideration, the present invention is aimed at alleviating the burden of a process of mounting the toner case to the developer by reducing a force required for mounting the toner case to the developer.

In addition, taking the above discussed circumstances into consideration, the present invention is aimed at providing a toner case that allows smooth rotation of a shutter with a small force, while preventing increase in cost.

Means for Solving the Problems

This image forming apparatus is provided with a toner case and a developer. The toner case includes a case body provided with a discharge port for discharging toner, and a case-side shutter for opening and closing the discharge port. A developer includes a developer body provided with a replenishing port for accepting the toner discharged from the discharge port and a developer-side shutter for opening and closing the replenishing port, and the toner case is detachably mounted to the developer. In the image forming apparatus according to the present invention, when the toner case has been mounted to the developer and the case-side shutter is displaced from a position where the discharge port is closed to a position where the discharge port is open, the case-side shutter pushes the developer-side shutter and is displaced from a position where the replenishing port is closed to a position where the replenishing port is open.

The toner case according to the present invention includes a case body provided with a discharge port for discharging toner, and a case-side shutter for opening and closing the discharge port. The toner case is detachably mounted to the developer. When the toner case has been mounted to the developer and the case-side shutter is displaced from a position where the discharge port is closed to a position where the discharge port is open, the case-side shutter pushes the developer-side shutter and the developer-side shutter is displaced from a position where the replenishing port provided in the developer is closed to a position where the replenishing port is open.

A toner case according to the present invention includes a case body provided with a discharge port for discharging toner, and a case-side shutter that rotates with respect to the case body for opening and closing the discharge port. The toner case according to the present invention is characterized in that a guide portion is provided in one of the case body and the case-side shutter along a rotational direction of the case-side shutter, and a projection portion that is engageable with the guide portion is provided in the other one of the case body and the case-side shutter.

Explanation of Reference Numerals

Figure 1:
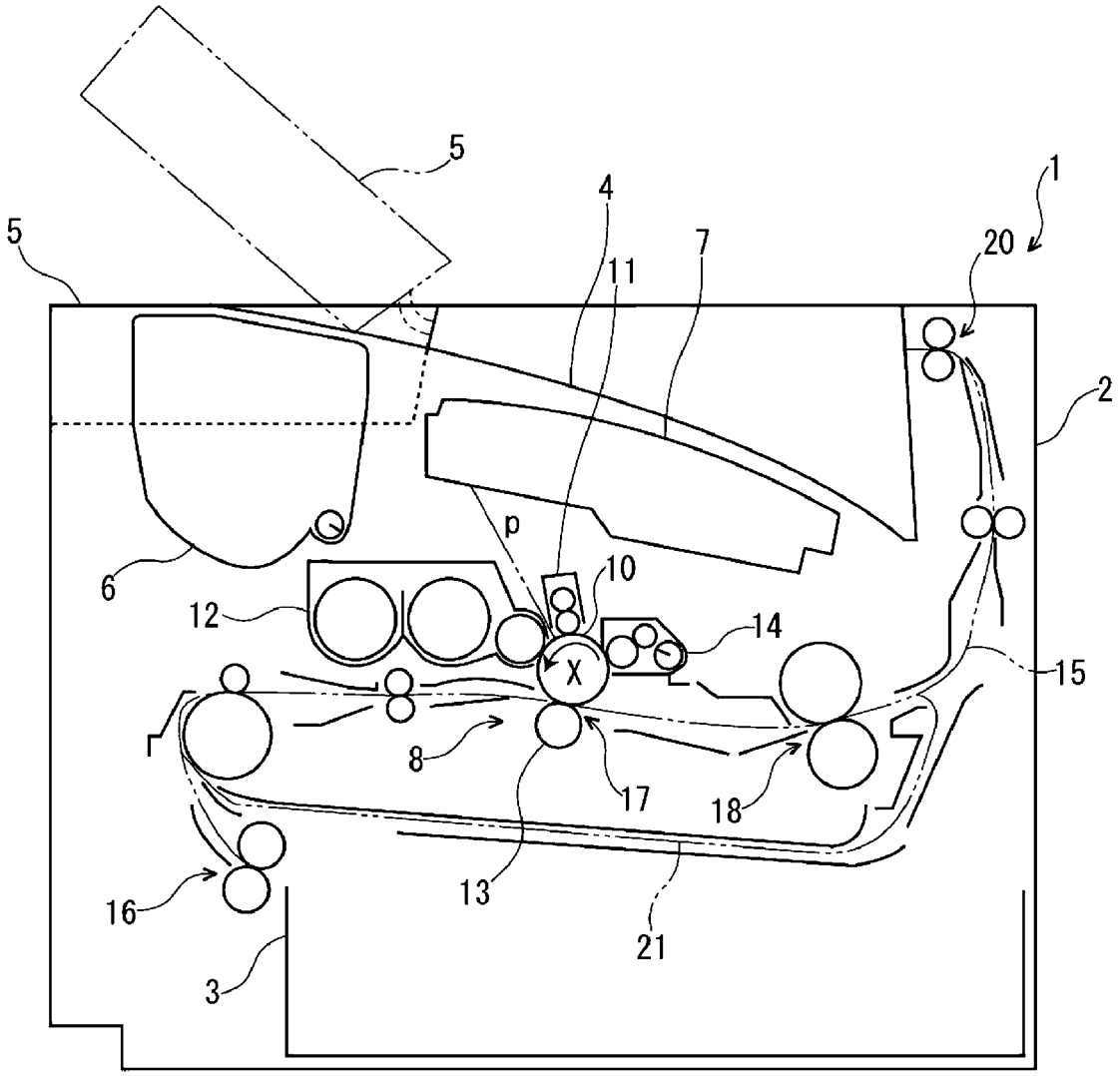
FIG. 1 is a schematic view of a printer according to a first embodiment of the present invention.

1 Printer (Image forming apparatus)
6 Toner container (Toner case)
12 Developer
22 Case body
26 Lever
28 Case-side shutter
34 Discharge duct
35 Discharge port
46 Projection portion
64 Lever-side gear
72 Guide hole (guide portion)
76 Shutter-side gear
80 Pressing projection
81 Guide groove (guide portion)
83 Developer main body
88 Replenishing port
98 Developer-side shutter

Preferred Mode for Carrying out the Ivention

First Embodiment

An overall configuration of a printer 1 employing xerography is described with reference to FIG. 1. FIG. 1 is a schematic view of a printer according to a first embodiment of the present invention. As used herein, a left side of a sheet in FIG. 1 is referred to as a front side of the printer 1.

The printer 1 according to the first embodiment includes a printer main body 2 having a box-like shape. A paper feeding cassette 3 for storing paper (not illustrated) is housed in a lower portion of the printer main body 2. An ejected paper tray 4 is provided on an upper face of the printer main body 2. An upper cover 5 is attached to be openable and closable to the upper face of the printer main body 2, in front of the ejected paper tray 4. A toner container 6 as a toner case is housed below the upper cover 5.

An exposure device 7 composed of a laser scanning unit (LSU) is disposed in an upper portion of the printer main body 2, below the ejected paper tray 4. An image formation unit 8 is provided below the exposure device 7. A photosensitive drum 10, which is an image supporting body, is rotatably provided in the image formation unit 8. In the periphery of the photosensitive drum 10, a charging device 11, a developer 12, a transfer roller 13, and a cleaning device 14 are arranged along a rotational direction (see an arrow X in FIG. 1) of the photosensitive drum 10.

A conveyance path 15 for paper is provided inside the printer main body 2. A paper feeding unit 16 is provided at an upstream side end of the conveyance path 15. A transfer unit 17 is provided in a midstream part of the conveyance path 15. The transfer unit 17 is formed by the photosensitive drum 10 and the transfer roller 13. A fusing device 18 is provided in a downstream side part of the conveyance path 15. A paper ejecting unit 20 is provided at a downstream side end of the conveyance path 15. A reversing path 21 for duplex printing is formed below the conveyance path 15.

Next, an image forming operation of the printer 1 having such a configuration is described.

When the printer 1 is turned on, various parameters are initialized. In addition, initial setting such as temperature setting of the fusing device 18 takes place. And then, when image data is input from a computer or the like connected to the printer 1 and a print start instruction is made, image forming operation is performed as follows.

First, the charging device 11 electrically charges the surface of the photosensitive drum 10, and then a laser beam (see a dashed-two-dotted line p in FIG. 1) from the exposure device 7 performs exposure with respect to the photosensitive drum 10 according to the image data. An electrostatic latent image is thus formed on a surface of the photosensitive drum 10. And then, a developing device 12 develops the electrostatic latent image with a toner, to form a toner image.

Meanwhile, the paper picked up by the paper feeding unit 16 from the paper feeding cassette 3 is conveyed to the transfer unit 17 in sync with the image forming operation described above. In the transfer unit 17, the toner image on the photosensitive drum 10 is transferred to the paper. The paper with the toner image thus transferred thereto is conveyed toward a downstream side of the conveyance path 15 and enters the fusing device 18. In the fusing device 18, the toner image is fused onto the paper. Paper onto which the toner image is fused is then discharged from the paper ejecting unit 20 to the ejected paper tray 4. It should be noted that the residual toner on the photosensitive drum 10 is removed by the cleaning device 14.

Figure 2:
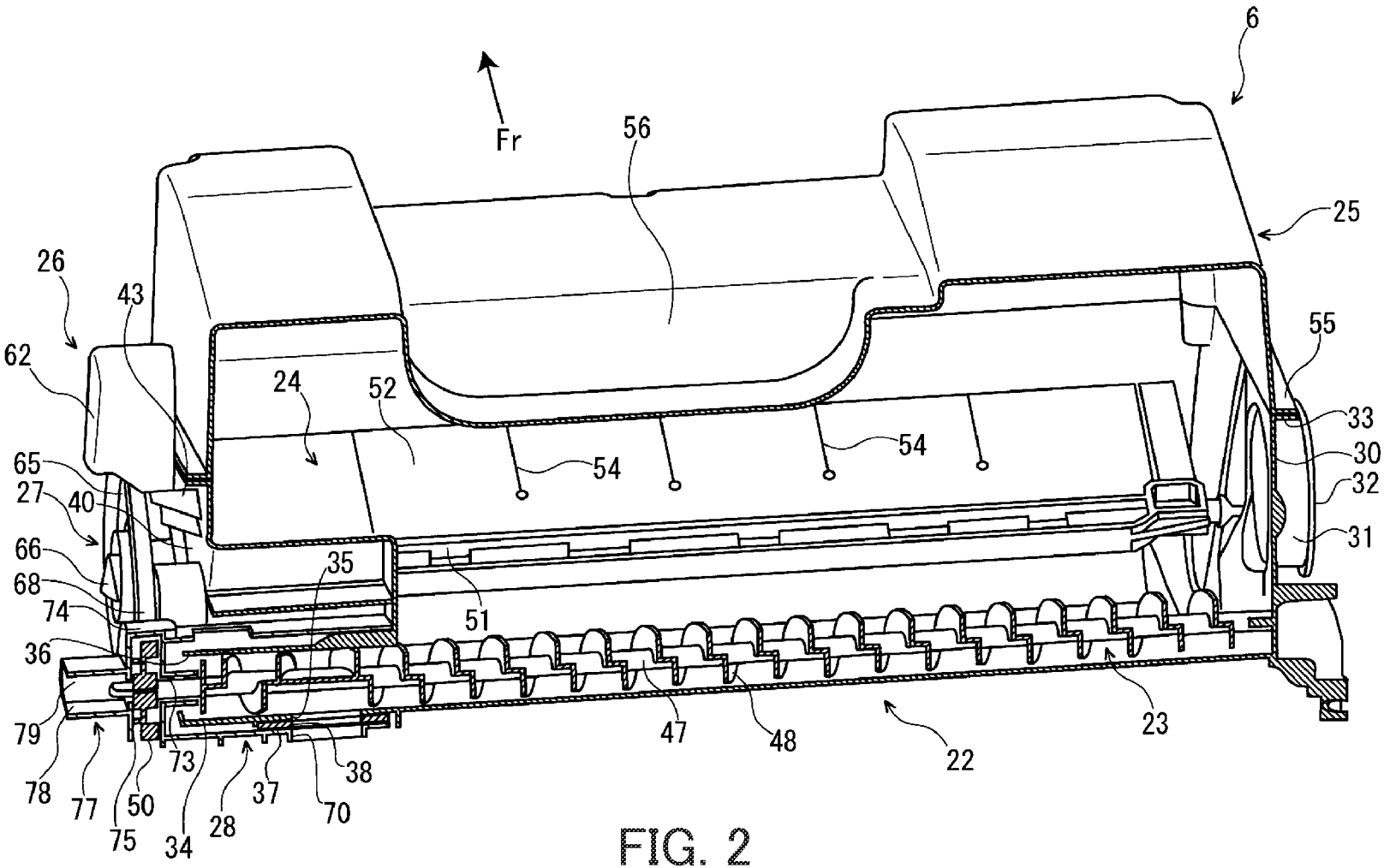
FIG. 2 is a perspective cross-sectional view taken from a rear side, showing a toner container in the printer according to the first embodiment of the present invention.
Figure 3:
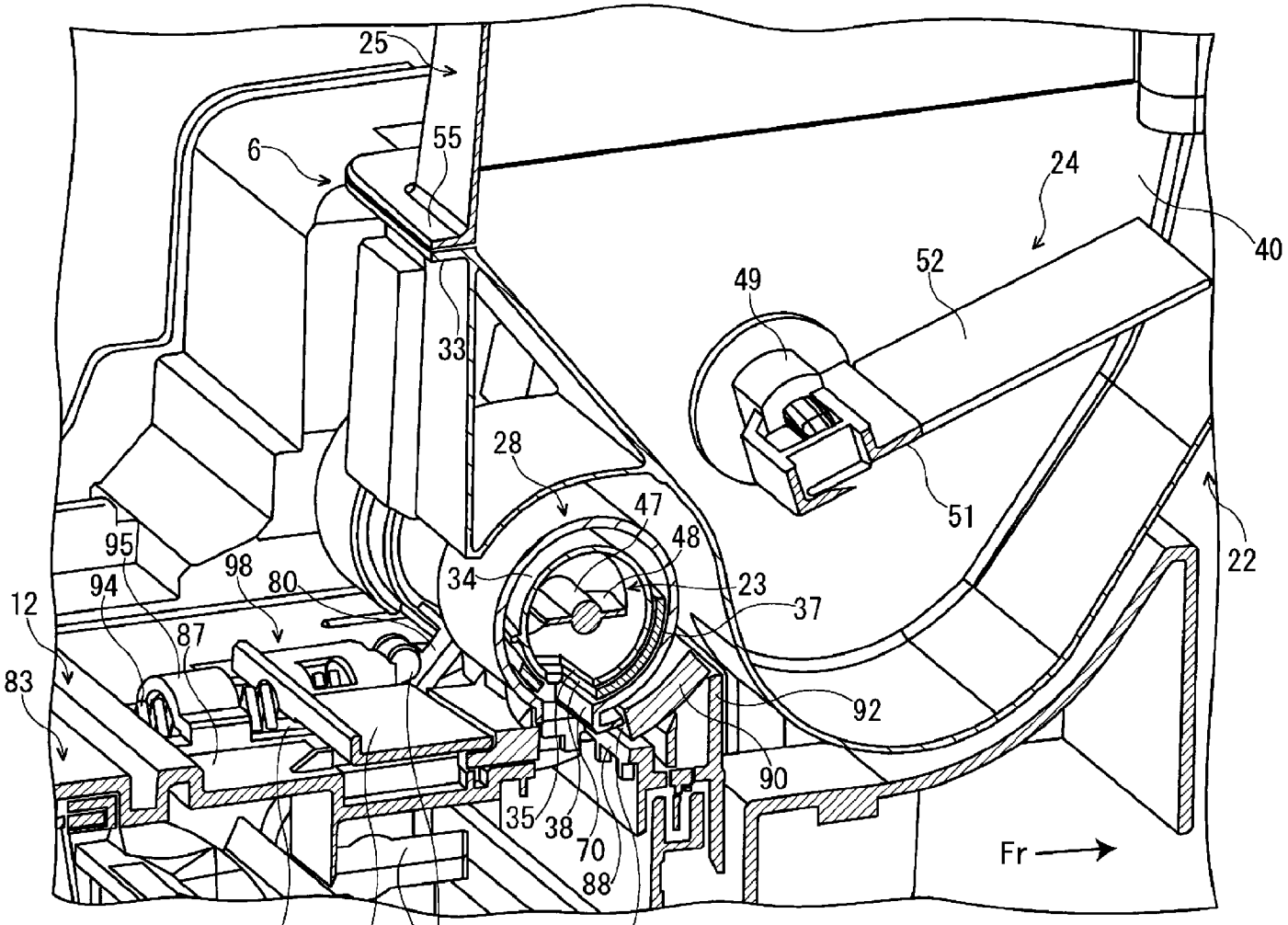
FIG. 3 is a perspective cross-sectional view taken from a left rear side, showing a state in which the case-side shutter opens the discharge port and the developer-side shutter opens the replenishing port in the printer according to the first embodiment of the present invention.
Figure 4:
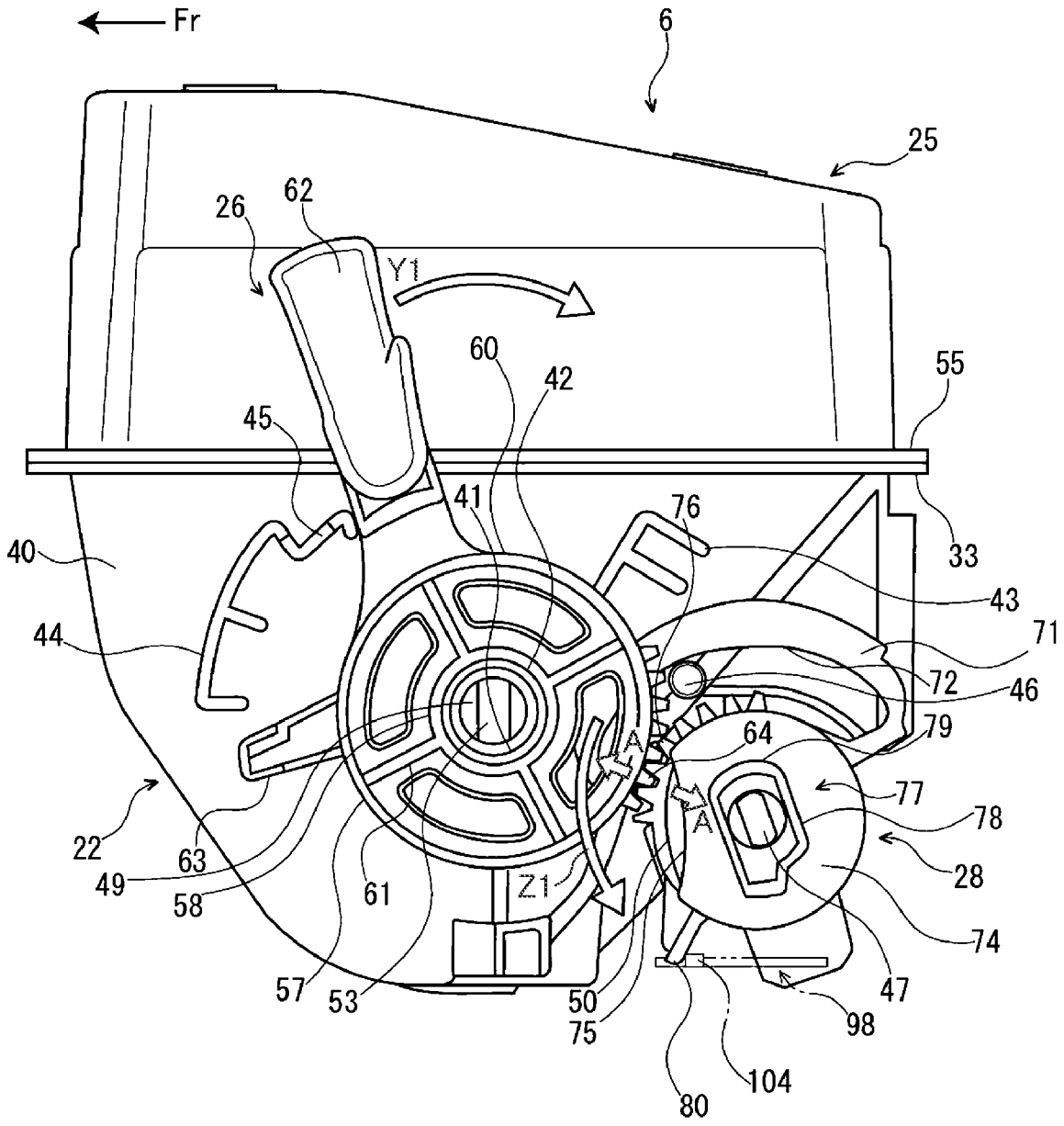
FIG. 4 is a right side view showing a state in which a grip portion of the lever is tilted forward in the toner container of the printer according to the first embodiment of the present invention.
Figure 5:
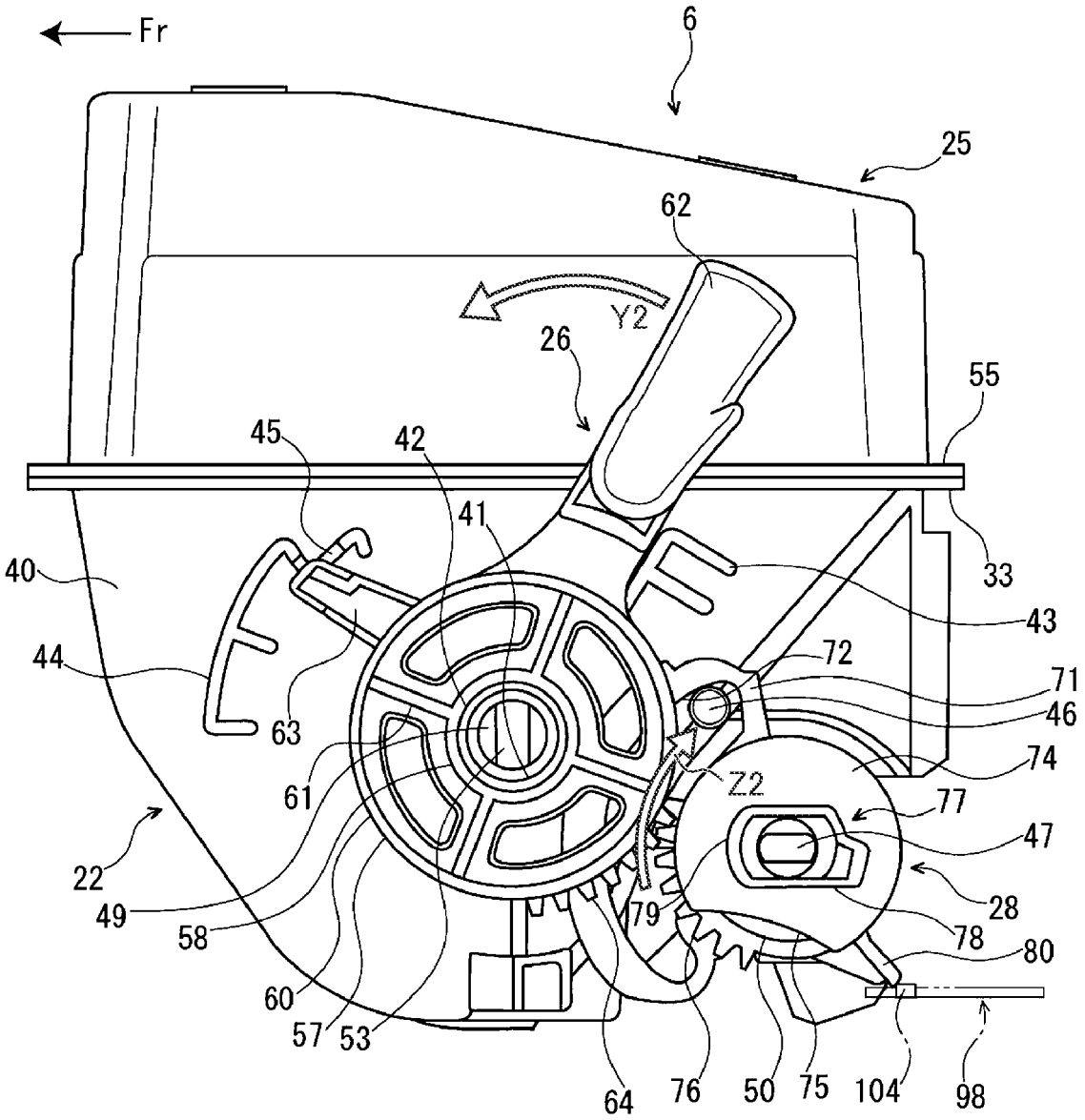
FIG. 5 is a right side view showing a state in which the grip portion of the lever is tilted rearward in the toner container of the printer according to the first embodiment of the present invention.
Figure 6:
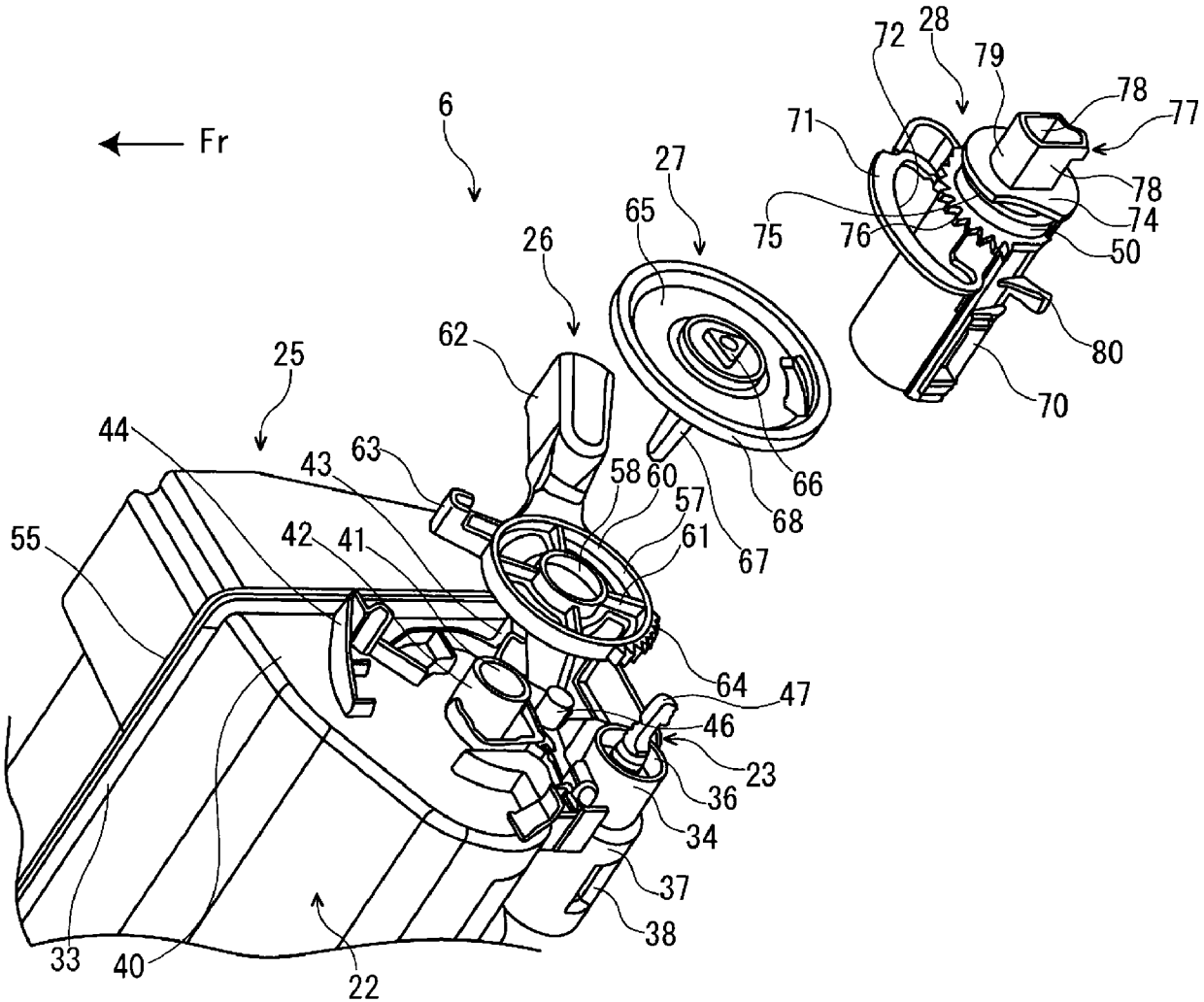
FIG. 6 is an exploded perspective view showing the toner container in the printer according to the first embodiment of the present invention.
Figure 7:
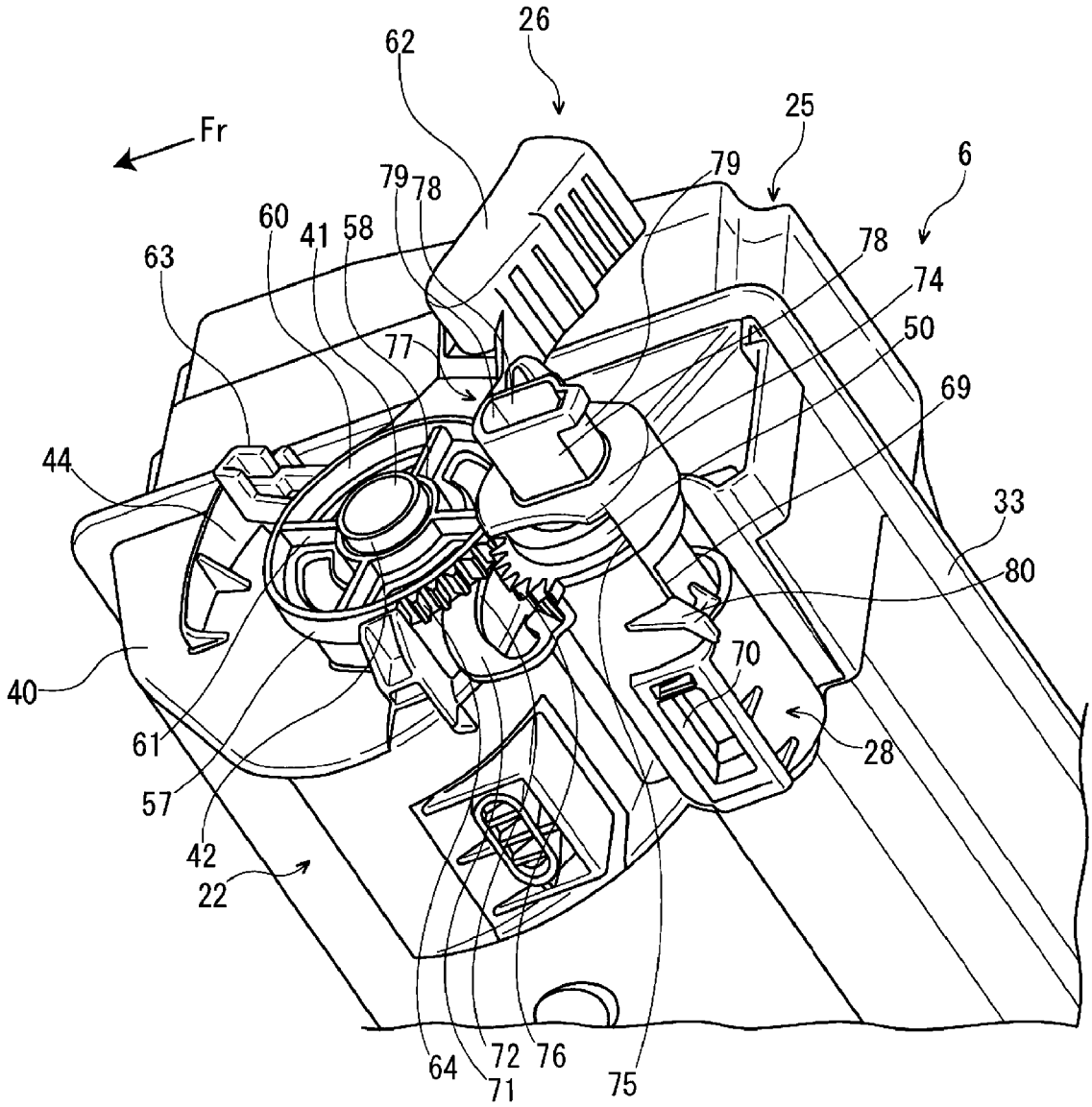
FIG. 7 is a perspective view taken from a right lower side, showing the toner container in the printer according to the first embodiment of the present invention.
Figure 13:
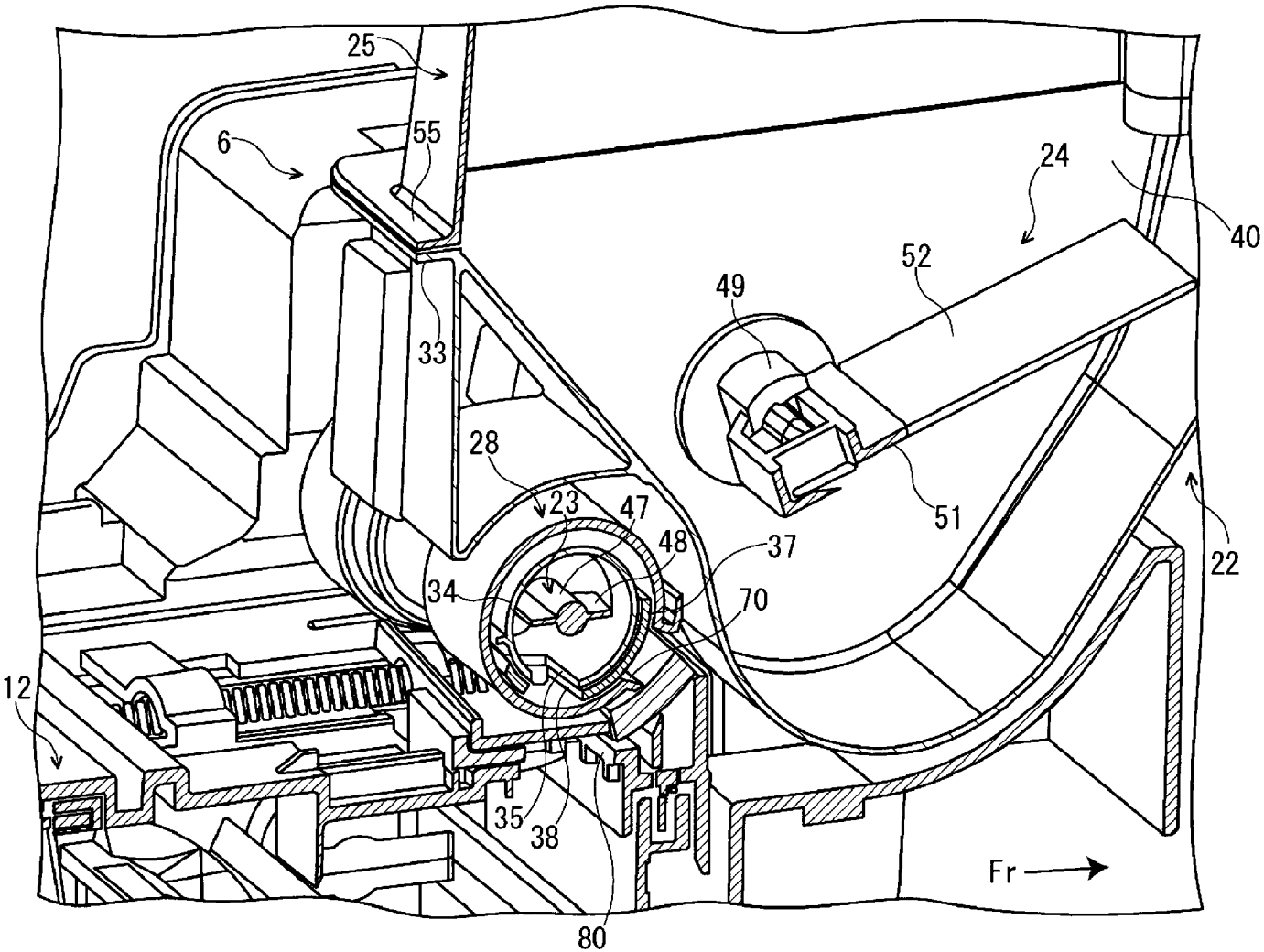
FIG. 13 is a perspective cross-sectional view taken from a left rear side, showing a state in which the shutter is closed in the toner container of the printer according to the first embodiment of the present invention.

Next, the toner container 6 is described in detail with reference mainly to FIGS. 2 to 7 and 13. FIG. 2 is a perspective cross-sectional view taken from a rear side, showing a toner container in the printer according to the first embodiment of the present disclosure. FIG. 3 is a perspective cross-sectional view taken from a left rear side, showing a state in which the case-side shutter opens the discharge port and the developer-side shutter opens the replenishing port in the printer according to the first embodiment of the present invention. FIG. 4 is a right side view showing a state in which a grip portion of the lever is tilted forward in the toner container of the printer according to the first embodiment of the present invention. FIG. 5 is a right side view showing a state in which the grip portion of the lever is tilted rearward in the toner container of the printer according to the first embodiment of the present invention. FIG. 6 is an exploded perspective view showing the toner container in the printer according to the first embodiment of the present invention. FIG. 7 is a perspective view taken from a right lower side, showing the toner container in the printer according to the first embodiment of the present disclosure. FIG. 13 is a perspective cross-sectional view taken from a left rear side, showing a state in which the shutter is closed in the toner container of the printer according to the first embodiment of the present invention.

An arrow Fr provided in each of the drawings as necessary indicates a front side (foreside) of the printer 1 (the same applies to FIG. 8 and later). It should be noted that FIG. 2 is a perspective cross-sectional view from a rear side and a left-to-right relationship in the drawing is reversed from an actual left-to-right relationship. In other words, a right side in FIG. 2 is a left side of the toner container 6. A left side in FIG. 2 is a right side of the toner container 6.

As shown in FIG. 1, the toner container 6 is disposed below the upper cover 5 of the printer main body 2. The toner container 6 is detachably mounted to the developer 12. The toner container 6 is configured to be replaceable in a case in which the toner is run out by opening the upper cover 5 (see a dashed-two-dotted line in FIG. 1).

As shown in FIG. 2, the toner container 6 is provided with a case body 22, a conveyance screw 23, a stirring paddle 24, a lid body 25, a lever 26, a transmission member 27, and a case-side shutter 28. The case body 22 has a box-like shape with an upper face being open. The conveyance screw 23 is stored in a lower part of a rear side of the case body 22. The stirring paddle 24 is stored in a substantially central part of the case body 22. The lid body 25 covers an upper face of the case body 22. The lever 26 is mounted to a right end portion of the case body 22. The transmission member 27 is disposed in a right end part of the case body 22 along with the lever 26. The case-side shutter 28 is mounted to a lower end part of a right side of the case body 22. It should be noted that illustration of the transmission member 27 is omitted except for FIGS. 2 and 6.

The case body 22 stores the toner. The case body 22 has a laterally elongated shape. A toner supply opening 31 is formed on a left end wall 30 of the case body 22. The toner supply opening 31 is blocked by a cap 32. A main body-side flange portion 33 is provided on an outer periphery of an upper end of the case body 22.

A cylindrical discharge duct 34 is provided to project rightward at a lower end part of a right side of the case body 22. An opening portion 36 is formed at a right end part of the discharge duct 34. As shown in FIG. 3, a discharge port 35 for discharging the toner is provided at a bottom part of the discharge duct 34. A sealing member 37 is attached to an outer periphery of a lower part of the discharge duct 34. The sealing member 37 is provided with a communicating opening 38 at a position corresponding to the discharge port 35.

As shown in FIG. 4, a cylindrical boss 42 is provided to project rightward (outward) at a center of the right end wall 40 of the case body 22. The boss 42 has a communicating hole 41. A first restricting rib 43 is provided to project from a right face (outer face) of the right end wall 40 of the case body 22, on a rear side of an upper side of the boss 42. A second restricting rib 44 is provided to project from a right face of the right end wall 40 of the case body 22, on a front side of an upper side of the boss 42. A concave portion 45 is provided above the second restricting rib 44. A cylindrical projection portion 46 is provided on a right face of the right end wall 40 of the case body 22, below the first restricting rib 43.

As shown in FIG. 2, the conveyance screw 23 has a laterally elongated shape. The conveyance screw 23 includes a rod-shaped rotational shaft 47 and spiral fins 48 provided concentrically in an outer circumference of the rotational shaft 47. A left end part of the rotational shaft 47 is pivotally supported by a left end wall 30 of the case body 22. Right end parts of the rotational shaft 47 and the spiral fin 48 are inserted into the discharge duct 34. The right end part of the rotational shaft 47 projects more rightward than the discharge duct 34 through the opening portion 36. A conveyance gear 50 is fixed to the projecting part.

The stirring paddle 24 is disposed on a front side of an upper side of the conveyance screw 23. The stirring paddle 24 has a laterally elongated shape. The stirring paddle 24 includes a supporting frame 51 which is a plate-like frame and a sheet-like stirring blade 52 which is supported by the supporting frame 51. Left and right end parts of the supporting frame 51 are pivotally supported by the left end wall 30 and the right end wall 40 of the case body 22 through bearings 49 (refer to FIG. 3; hereinafter referred to as "bearings 49 of the stirring paddle 24") respectively. As shown in FIG. 4 and the like, the bearing 49 of the stirring paddle 24 attached to the right end wall 40 is provided with an engagement receiving portion 53 at a position corresponding to the communicating hole 41 of the boss 42.

The stirring blade 52 is composed of, for example, a sheet made of a synthetic resin. As shown in FIG. 2 and the like, a first side of the stirring blade 52 is fixed to the supporting frame 51 along a lateral direction. The stirring blade 52 is provided with a plurality of slit grooves 54.

A lid body-side flange portion 55 is provided on a lower end of the lid body 25. The lid body-side flange portion 55 has a shape corresponding to the main body-side flange portion 33 in the case body 22. By welding the main body-side flange portion 33 with the lid body-side flange portion 55 by ultrasonic welding, the case body 22 and the lid body 25 are integrated. At a lateral center of the lid body 25, a concave portion 56 is formed.

As shown in FIG. 4 and the like, the lever 26 includes a lever main body 57. The lever main body 57 has a circular outline in a side view. The lever main body 57 includes a cylindrical small diameter cylinder portion 58, a cylindrical large diameter cylinder portion 60, and four connecting portions 61. The large diameter cylinder portion 60 is provided in an outer periphery of the small diameter cylinder portion 58. The four connecting portions 61 extend radially to connect the small diameter cylinder portion 58 with the large diameter cylinder portion 60. The small diameter cylinder portion 58 is attached to an outer periphery of the boss 42. The boss 42 is provided on the right end wall 40 of the case body 22. The lever 26 is thus rotatably supported by the case body 22.

A grip portion 62 is provided to project above the large diameter cylinder portion 60. An upper end of the grip portion 62 extends up to a right side of the lid body 25. A forward tilt angle of the grip portion 62 is restricted by the second restricting rib 44 (refer to FIG. 4). A backward tilt angle of the grip portion 62 is restricted by the first restricting rib 43 (refer to FIG. 5). In an upper part of the large diameter cylinder portion 60, a projection 63 is provided in front of the grip portion 62. As shown in FIG. 5, the projection 63 engages with the concave portion 45 of the second restricting rib 44 in a state in which the grip portion 62 is tilted backward. A lever-side gear 64 is provided on an outer periphery of a lower part of a rear side of the large diameter cylinder portion 60.

As shown in FIG. 6, the transmission member 27 includes a disc-shaped transmission member main body 65. On a right face (outer face) of the disc-shaped transmission member main body 65, a transmission coupling 66, which has a triangular prism shape in a side view, is provided to project. On a left face (inner face) of the disc-shaped transmission member main body 65, an engagement piece 67 is provided to project. The engagement piece 67 is inserted into the communicating hole 41. The communicating hole 41 is provided on the boss 42 of the case body 22. The engagement piece 67 engages with the engagement receiving portion 53 provided on the bearing 49 of the stirring paddle 24 (refer to FIG. 4 and the like). The transmission member 27 and the stirring paddle 24 are thus connected, allowing the transmission member 27 and the stirring paddle 24 to rotate integrally.

As shown in FIG. 6, a transmission gear 68 is provided on an outer periphery of the transmission member 65. The transmission gear 68 engages with the conveyance gear 50 (shown in a state of being separated from the rotational shaft 47 in FIG. 6) fixed to the rotational shaft 47 of the conveyance screw 23. The conveyance screw 23 is configured to rotate according to rotation of the transmission member 27.

The case-side shutter 28 has a cylindrical shape. The case-side shutter 28 is attached rotatably to an outer periphery of the discharge duct 34 of the case body 22. A discharge opening portion 70 is formed on a lower face of the case-side shutter 28. As shown in FIG. 3, the discharge opening portion 70 is provided at a position corresponding to the discharge port 35 of the case body 22 and the communicating opening 38 of the sealing member 37.

As shown in FIG. 4 and the like, the case-side shutter 28 is provided with a guide piece 71, which has a substantially fan-like shape, projecting forward. The guide piece 71 has an arc-like guide hole 72 as the guide portion. The projection portion 46 of the case body 22 engages with the guide hole 72. The guide hole 72 is provided along a rotational direction (refer to an arrow Y2 in FIG. 5) of the shutter 28.

As shown in FIG. 2, the case-side shutter 28 is provided with a cylindrical bearing 73. The bearing 73 pivotally supports the right end part of the rotational shaft 47 of the conveyance screw 23. A gear storage portion 74 is provided on a right side of the bearing 73. The gear storage portion 74 stores the conveyance gear 50. As shown in FIG. 7, a communicating opening portion 75 is formed on the gear storage portion 74. The gear storage portion 74 is configured to store the conveyance gear 50 through the communicating opening portion 75.

The case-side shutter 28 is provided with a shutter-side gear 76. The shutter-side gear 76 engages with a lever-side gear 64 of the lever 26. The case-side shutter 28 is configured to rotate in an opposite direction to that of the lever 26, according to rotation of the lever 26. A lock piece 77 is provided in a right end part of the case-side shutter 28. The lock piece 77 includes a pair of opposite planar portions 78 and a pair of curved portions 79 that connects both ends of the planar portions 78. A cross-section of the lock piece 77 has a curved convex shape. A pressing projection 80 is provided on an outer periphery of a lower part of the case-side shutter 28, on a right side of the discharge opening portion 70. A window portion 69 is provided above the pressing projection 80.

Figure 9:
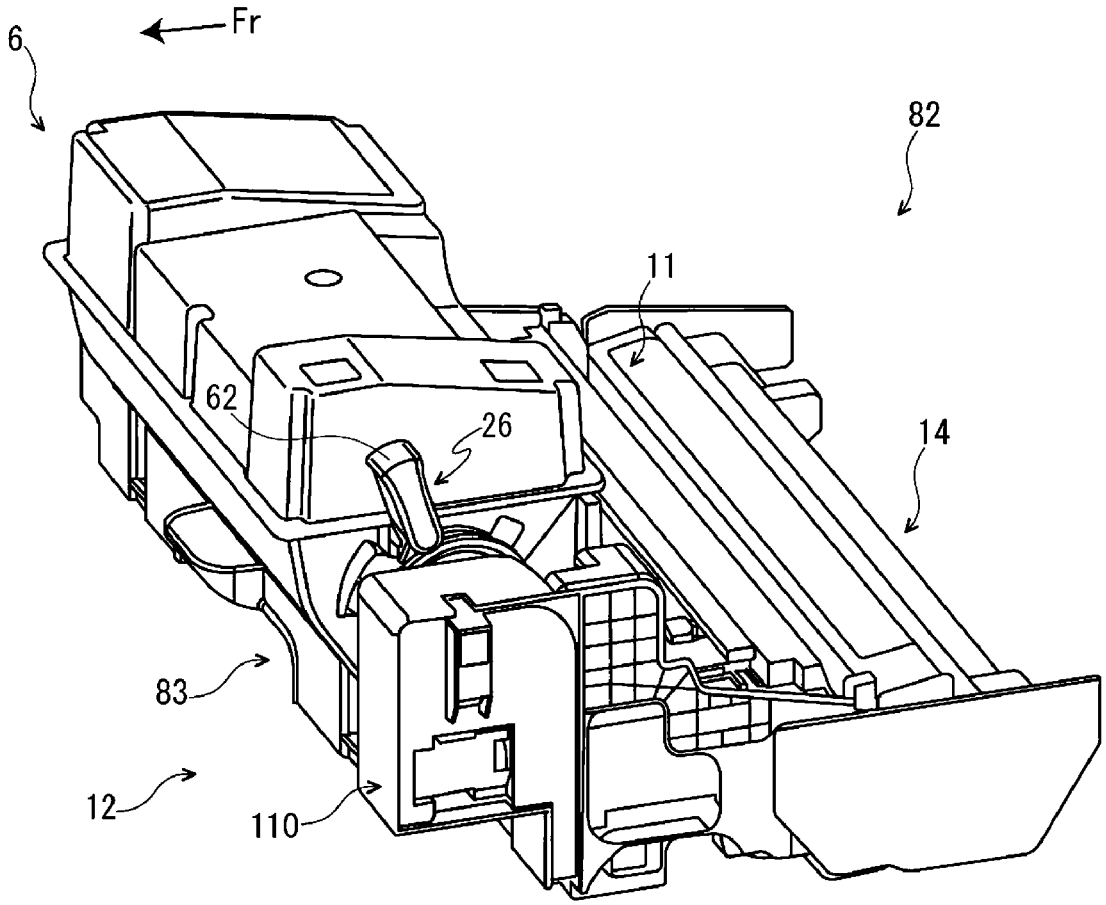
FIG. 9 is a perspective view taken from a right front side, showing a state in which the toner container is mounted to the developer in the printer according to the first embodiment of the present invention.
Figure 10:
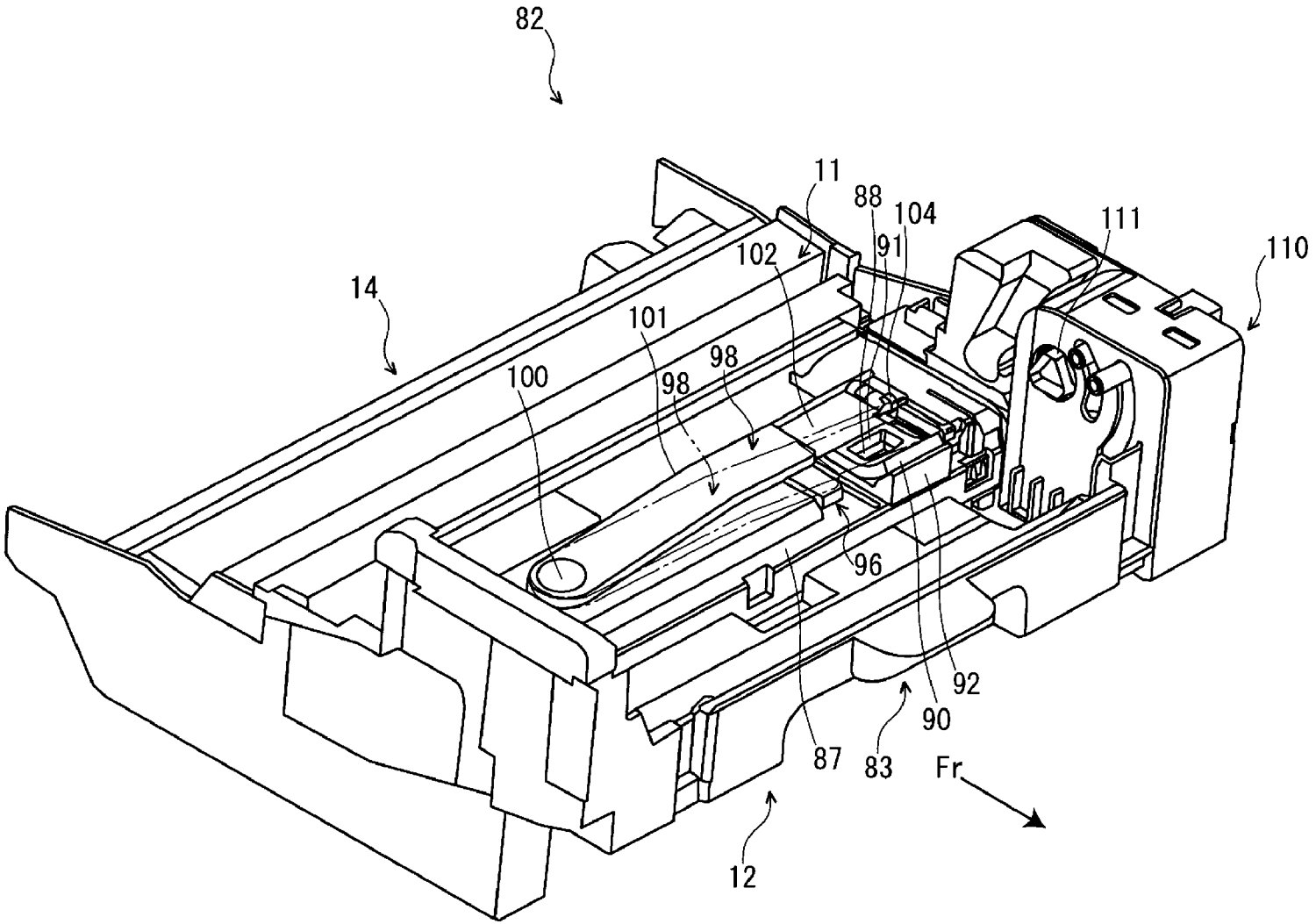
FIG. 10 is a perspective view taken from a left front side, showing the image formation unit of the printer according to the first embodiment of the present invention.
Figure 11:
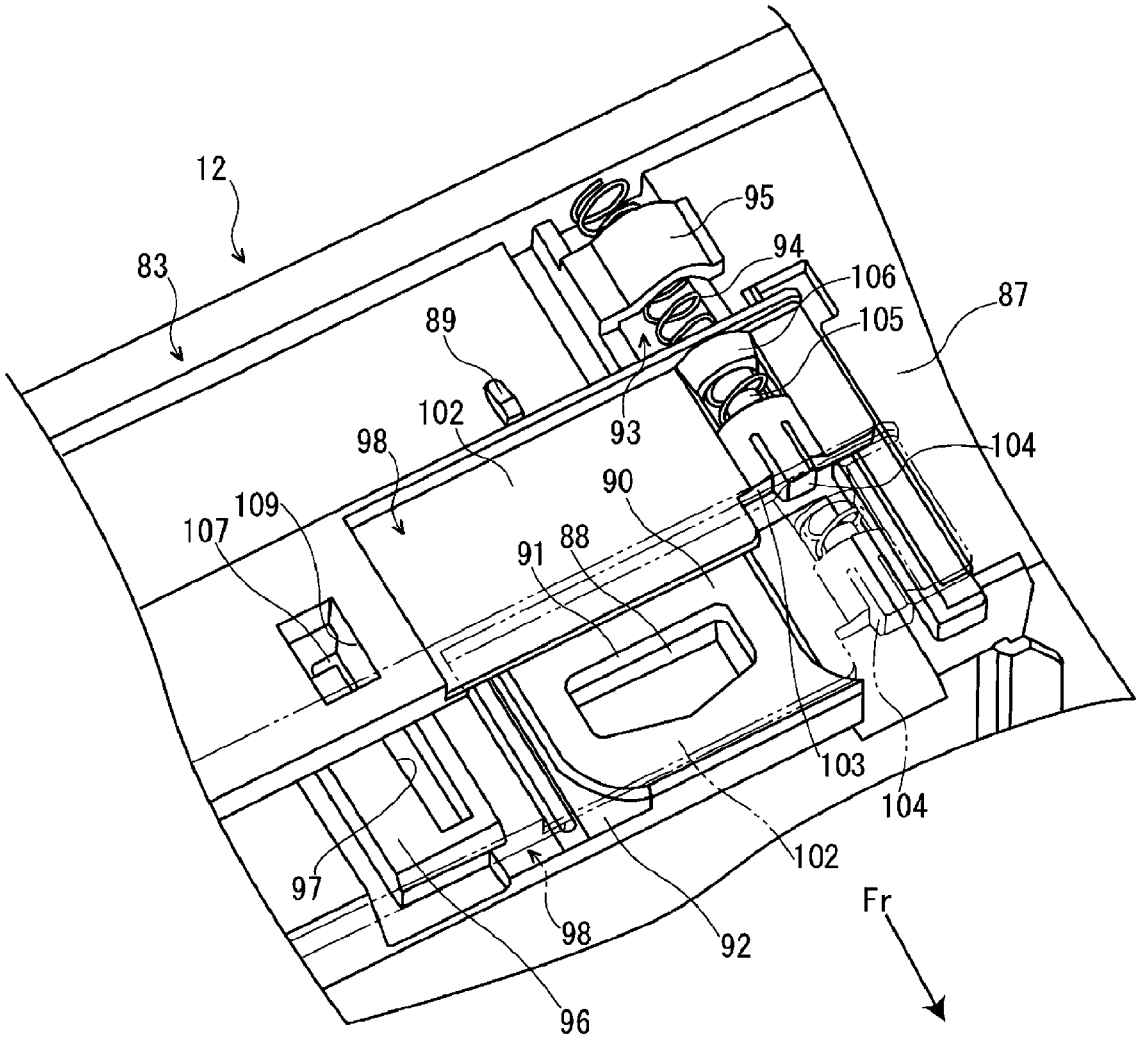
FIG. 11 is a perspective view showing the periphery of a replenishing port in a developer of the printer according to the first embodiment of the present invention.
Figure 12:
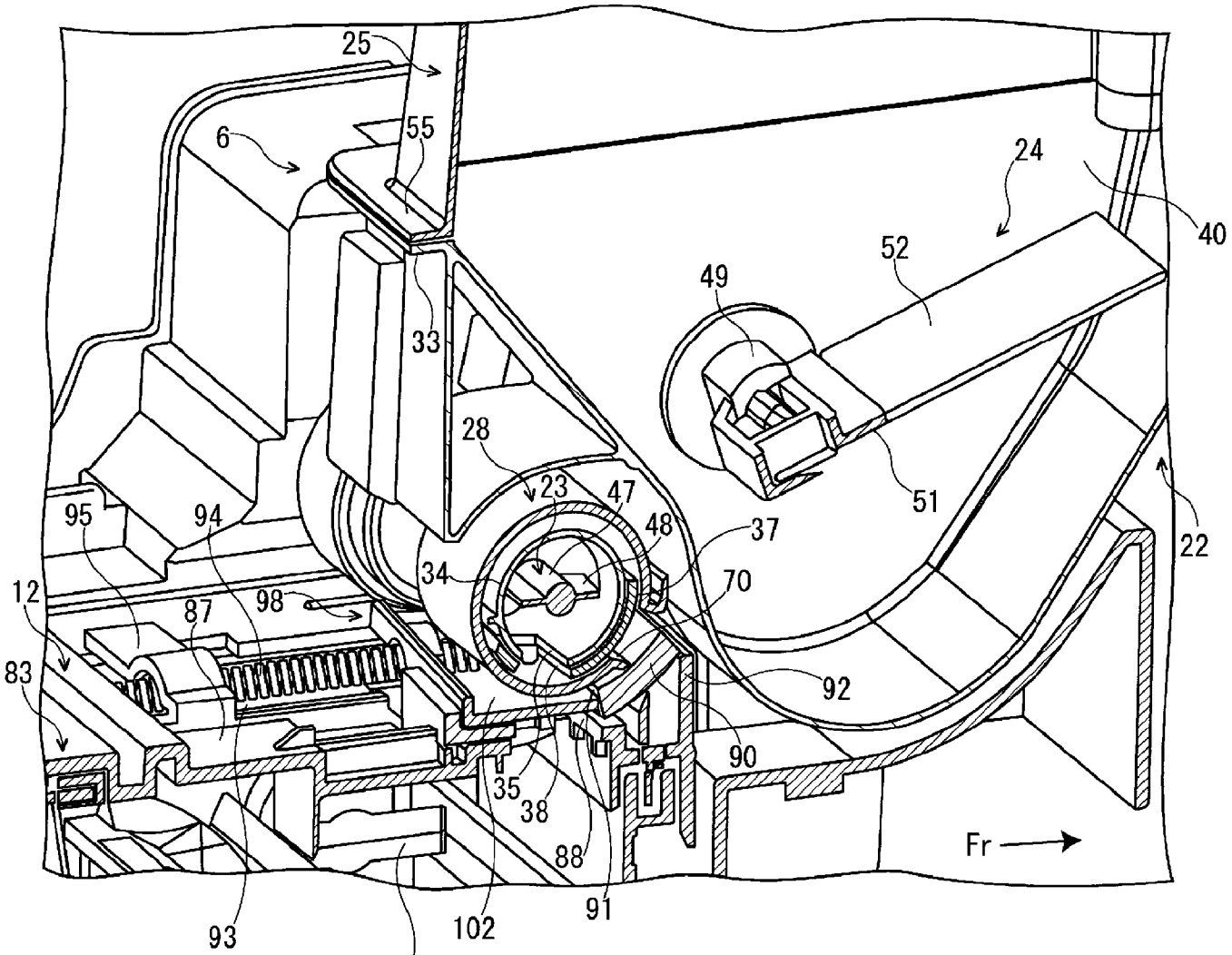
FIG. 12 is a perspective cross-sectional view taken from a left rear side, showing a state in which the case-side shutter closes the discharge port and the developer-side shutter closes the replenishing port in the printer according to the first embodiment of the present invention.

Next, the developer 12 is described in detail with reference to FIG. 3 and FIGS. 8 to 12. FIG. 3 is a perspective cross-sectional view taken from a left rear side, showing a state in which the case-side shutter opens the discharge port and the developer-side shutter opens the replenishing port in the printer according to the first embodiment of the present invention. FIG. 8 is a schematic view schematically showing an image formation unit of the printer according to the first embodiment of the present invention. FIG. 9 is a perspective view taken from a right front side, showing a state in which the toner container is mounted to the developer in the printer according to the first embodiment of the present invention. FIG. 10 is a perspective view taken from a left front side, showing the image formation unit of the printer according to the first embodiment of the present invention. FIG. 11 is a perspective view showing the periphery of a replenishing port in a developer of the printer according to the first embodiment of the present invention. FIG. 12 is a perspective cross-sectional view taken from a left rear side, showing a state in which the case-side shutter closes the discharge port and the developer-side shutter closes the replenishing port in the printer according to the first embodiment of the present invention.

Figure 8:
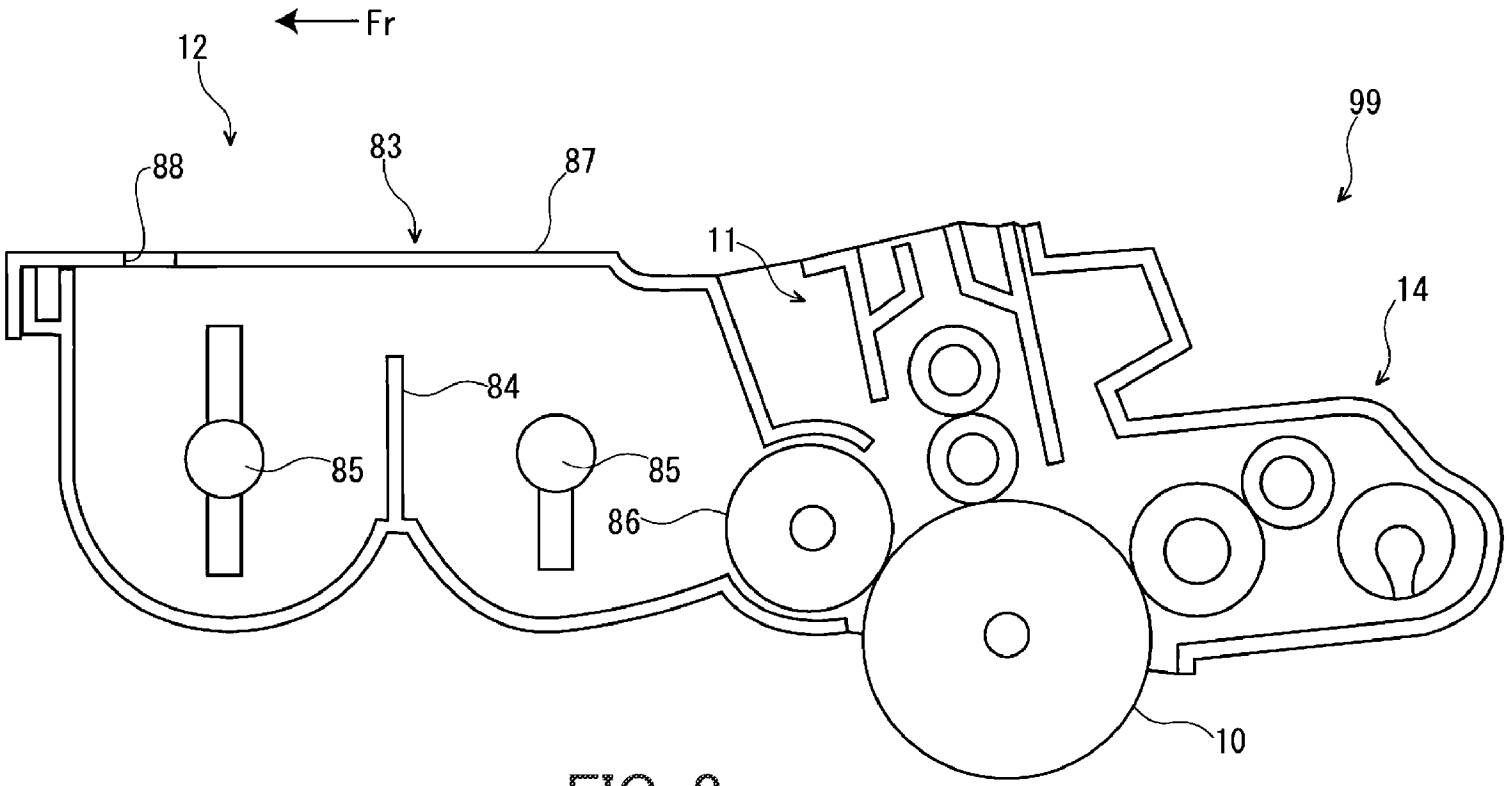
FIG. 8 is a schematic view schematically showing an image formation unit of the printer according to the first embodiment of the present invention.

As shown in FIG. 8, the developer 12, the photosensitive drum 10, the charging device 11, and the cleaning device 14 integrally constitute an image formation unit 99. The developer 12 includes a box-shaped developer main body 83. A partition 84 that extends vertically is provided at a center of an inner part of the developer main body 83. Stirring members 85 are stored respectively in front of and behind the partition 84. Each stirring member 85 is rotatably supported by the developer main body 83. In the developer main body 83, a developing roller 86 is stored in a lower part of a rear side of the stirring member 85 on a rear side. The development roller 86 is rotatably supported by the developer main body 83. The developing roller 86 is in contact with a surface of the photosensitive drum 10. As shown in FIG. 9, the toner container 6 is detachably mounted to an upper face side of the developer main body 83.

As shown in FIG. 3 and the like, the replenishing port 88 is provided on an upper wall 87 of the developer main body 83 to be vertically communicating. The sealing member 90 is fixed to a periphery of the replenishing port 88, on an upper face (a part of an outer face of the developer main body 83) of the upper wall 87 of the developer main body 83. The sealing member 90 is formed of an elastic member such as sponge. As shown in FIGS. 10 and 11, a replenishing opening portion 91 is formed on the sealing member 90 at a position corresponding to the replenishing port 88 of the developer main body 83. A front end part of the sealing member 90 is placed on a base portion 92. The base portion 92 is provided on the upper wall 87 of the developer main body 83 to project therefrom. The front end part of the sealing member 90 is curved in an arc shape, toward an upper part of a front side.

As shown in FIG. 11, a restricting projection 89 is provided to project behind the sealing member 90, on an upper face of the upper wall 87 of the developer main body 83. A spring storage portion 93 is formed along an anteroposterior direction on a right side of the sealing member 90, on the upper face of the upper wall 87 of the developer main body 83. The spring storage portion 93 stores a coil spring 94 as a biasing member. A rear end part of the coil spring 94 is in contact with a rear face of the spring storage portion 93. An upper side of a rear part of the coil spring 94 is covered by an arc shaped spring supporting piece 95. The spring supporting piece 95 is disposed across an upper side of the spring storage portion 93.

An engaging portion 96 is provided to project along an anteroposterior direction, on a left side of the sealing member 90 on the upper face of the upper wall 87 of the developer main body 83. An engaging groove 97 is formed on the engaging portion 96 along the anteroposterior direction.

As shown in FIG. 10 and the like, the developer-side shutter 98 is attached to the upper face side of the upper wall 87 of the developer main body 83. The developer-side shutter 98 has a laterally elongated planar shape. A fulcrum portion 100 is provided in a left end part of the developer-side shutter 98. The developer-side shutter 98 is configured to rotate in an anteroposterior direction about the fulcrum portion 100, along an upper face of the upper wall 87 of the developer main body 83. A gently curved bent portion 101 is formed on a lateral central part of the developer-side shutter 98.

As shown in FIG. 11, a thin open-close portion 102 is provided on a right side part of the developer-side shutter 98. A lower face of the open-close portion 102 is in contact with an upper face of the sealing member 90. According to rotation of the developer-side shutter 98 about the fulcrum portion 100, the open-close portion 102 opens and closes the replenishing port 88 on the developer main body 83 as well as the replenishing opening portion 91 on the sealing member 90. Hereinafter, a position of the open-close portion 102 that opens the toner replenishing port 88 on the developer main body 83 and the replenishing opening portion 91 on the sealing member 90 (refer to FIG. 3) is referred to as an open position. A position of the open-close portion 102 that closes the toner replenishing port 88 on the developer main body 83 and the replenishing opening portion 91 on the sealing member 90 (refer to FIG. 12) is referred to as a close position.

As shown in FIG. 11, a rectangular notch portion 103 is provided on the developer-side shutter 98, on a right side of the open-close portion 102. The notch portion 103 is provided with a contacting piece 104 that projects therefrom. As shown in FIG. 10, the contacting piece 104 is provided at a position that is farther from the fulcrum portion 100 than the open-close portion 102.

As shown in FIG. 11, a spring receiving portion 105 is provided behind the contacting piece 104. A front end part of the coil spring 94 is mounted to the spring receiving portion 105. The open-close portion 102 of the developer-side shutter 98 is thus biased toward the close position. An arc shaped spring supporting portion 106 is provided on the developer-side shutter 98, behind the spring receiving portion 105. The arc shaped spring supporting portion 106 covers an upper side of the coil spring 94.

A communicating hole 109 is provided on the developer-side shutter 98, on a left side of the open-close portion 102. An L-shaped hook 107 is provided to project from the communicating hole 109 toward the developer main body 83 (lower side in the present embodiment). The hook 107 is inserted into the engaging groove 97 provided on the engaging portion 96 of the developer main body 83 to engage with the engaging portion 96.

As shown in FIG. 10, a driving mechanism 110 is provided on a right end part of the developer main body 83. A driving coupling 111 is provided in the driving mechanism 110. The driving coupling 111 is connected to a driving means (not illustrated) such as a motor. The driving coupling 111 has a triangle tube-like shape.

In the above-described configuration, as shown in FIG. 9, the toner container 6 is mounted to the developer 12 in a state in which the grip portion 62 of the lever 26 is tilted forward. As the toner container 6 is mounted to the developer 12, as shown in FIG. 4, the pressing projection 80 of the case-side shutter 28 is brought into contact with the contacting piece 104 of the developer-side shutter 98. Here, as shown in FIG. 12, the discharge port 35 of the case body 22 is closed by the case-side shutter 28. The replenishing port 88 of the developer main body 83 is closed by the open-close portion 102 of the developer-side shutter 98. Communication is thus blocked between the inside of the case body 22 and the inside of the developer main body 83.

In this state, as an operator such as a user or a service person tilts the grip portion 62 of the lever 26 toward a rear side as shown by an arrow Y1 in FIG. 4, the lever 26 rotates in a direction (a clockwise direction in the drawing) shown by an arrow Y1 of FIG. 4 about the boss 42 of the case body 22 to be positioned at a position shown in FIG. 5. According to this rotation, the case-side shutter 28 connected to the lever 26 rotates in a direction (a counterclockwise direction in the drawing) with respect to the case body 22 as shown by an arrow Z1 in FIG. 4, to be positioned at a position shown in FIG. 5. By the rotation of the case-side shutter 28, as shown in FIG. 3, the discharge opening portion 70 of the case-side shutter 28 moves to a position immediately below the discharge port 35 of the case body 22 and the communicating opening 38 of the sealing member 37. In other words, the case-side shutter 28 is displaced to a position to open the discharge port 35 of the case body 22.

In addition, according to the above described rotation of the case-side shutter 28, as shown in FIGS. 4 and 5, the pressing projection 80 of the case-side shutter 28 presses the contacting piece 104 of the developer-side shutter 98 rearward. In response to this pressing, the developer-side shutter 98 rotates rearward about the fulcrum portion 100. And then, as shown in FIG. 3, the open-close portion 102 of the developer-side shutter 98 is displaced from the close position to the open position. In other words, the developer-side shutter 98 opens the replenishing port 88 of the developer main body 83. As described above, by opening the discharge port 35 of the case body 22 and the replenishing port 88 of the developer main body 83, the inside of the case body 22 and the inside of the developer main body 83 communicate with each other.

In the above described configuration, in a state in which the toner container 6 is mounted to the developer 12 and the grip portion 62 of the lever 26 is tilted rearward (see FIG. 5), as shown in FIG. 3, the discharge opening portion 70 of the case-side shutter 28 is positioned at a position immediately below the discharge port 35 of the case body 22 and the communicating opening 38 of the sealing member 37. In other words, the case-side shutter 28 opens the discharge port 35 of the case body 22. As a result, the inside of the case body 22 and the inside of the developer 12 communicate with each other through the discharge port 35 of the case body 22, the communicating hole 38 of the sealing member 37, the discharge opening portion 70 of the case-side shutter 28, and the replenishing port 88 provided in the developer 12.

In addition, in sync with the above described rotation of the lever 26, the driving coupling 111 is connected to the transmission coupling 66.

In addition, in a state in which the toner container 6 is mounted to the developer 12 and the grip portion 62 of the lever 26 is tilted rearward (see FIG. 5), the transmission coupling 66 of the transmission member 27 is connected to a driving coupling (not illustrated) connected to a driving means (not illustrated) such as a motor.

In this state, the driving means such as a motor that is connected to the driving coupling 111 rotates. As the driving means rotates, the rotation of the driving means is transmitted to the transmission member 27 via the driving coupling 111 and the transmission coupling 66, to rotate the transmission member 27. As the transmission member 27 rotates, the stirring paddle 24 that is connected to the transmission member 27 rotates. The toner in the case body 22 is stirred and conveyed toward the conveyance screw 23. In addition, as the transmission member 27 rotates as described above, the rotation of the transmission member 27 is transmitted to the rotational shaft 47 of the conveyance screw 23 via the transmission gear 68 and the conveyance gear 50, to rotate the conveyance screw 23. According to this, the toner in the case body 22 is discharged from the discharge port 35 and introduced to the inside of the developer main body 83 through the replenishing port 88.

The toner introduced to the inside of the developer main body 83 is stirred by each stirring member 85 and then conveyed to the developing roller 86. The toner conveyed to the developing roller 86 is supplied from the developing roller 86 to the photosensitive drum 10.

On the other hand, from a state in which the grip portion 62 of the lever 26 is tilted rearward as described above, the operator such as a user and a service person tilts the grip portion 62 of the lever 26 forward as shown by an arrow Y2 in FIG. 5. As the grip portion 62 of the lever 26 is tilted forward, the lever 26 rotates in a direction (a counterclockwise direction in the drawing) shown by an arrow Y2 of FIG. 5 about the boss 42 of the case body 22 to be positioned at a position shown in FIG. 4. According to this rotation, the case-side shutter 28 connected to the lever 26 rotates in a direction (a clockwise direction in the drawing) with respect to the case body 22 as shown by an arrow Z2 in FIG. 5, to be positioned at a position shown in FIG. 4. According to the rotation of the case-side shutter 28, the guide piece 71 of the case-side shutter 28 rotates in a state in which the projection portion 46 of the case body 22 is in contact with the outer periphery of the guide hole 72. By the above described rotation of the case-side shutter 28, as shown in FIG. 13, the discharge opening portion 70 of the case-side shutter 28 moves forward from a position immediately below the discharge port 35 of the case body 22 and the communicating opening 38 of the sealing member 37. Communication is then blocked between the inside of the case body 22 and the inside of the developer 12. In other words, the case-side shutter 28 closes the discharge port 35 of the case body 22.

As described above, in the present embodiment, as the pressing projection 80 of the case-side shutter 28 presses the contacting piece 104 of the developer-side shutter 98 in a state in which the toner container 6 is mounted to the developer 12, the developer-side shutter 98 rotates from a position where the replenishing port 88 is closed to a position where the replenishing port 88 is open. Given this, there is no need to rotate the developer-side shutter 98 when the toner container 6 is being mounted to the developer 12. In addition, no reaction force is applied from the developer-side shutter 98 to the toner container 6. A force necessary to mount the toner container 6 to the developer 12 can thus be reduced compared to a case in which the developer-side shutter 98 is displaced in conjunction with an act of mounting the toner container 6 to the developer 12. A workload of mounting the toner container 6 to the developer 12 can thus be reduced.

In addition, by rotatably mounting the cylindrical case-side shutter 28 to the outer periphery of the cylindrical discharge duct 34, the case-side shutter 28 is configured to rotate outside of the discharge duct 34. Given this, the pressing projection 80 of the case-side shutter 28 can be brought closer to the developer-side shutter 98, compared to a case in which the case-side shutter 28 rotates inside the discharge duct 34. Accordingly, it is made easier to press the developer-side shutter 98 by the pressing projection 80.

Furthermore, the lever 26 that is connected to the case-side shutter 28 is provided in the toner container 6. As a result, the discharge port 35 of the case body 22 and the replenishing port 88 of the developer main body 83 can easily be opened and closed according to an operation of the lever 26.

In the present embodiment, the guide hole 72 is provided on the case-side shutter 28. The projection portion 46 that can engage with the guide hole 72 is provided on the case body 22. As a result, the projection portion 46 is guided by the guide hole 72 during the above described rotation of the case-side shutter 28. And deviation of the rotational direction of the case-side shutter 28 from a predetermined direction can be prevented. As a result, the case-side shutter 28 can be rotated smoothly with a small force. In addition, since there is no need of addition of separate members and increase in thickness of the lever 26 and the case-side shutter 28, cost can be reduced.

Furthermore, a configuration is employed in which the arc-like guide hole 72 is formed on the case-side shutter 28. As a result, the entire case-side shutter 28 can be made more compact compared to a case in which a circular guide groove (refer to a second embodiment described later) is formed on the case-side shutter 28. Space saving is thus made possible.

Furthermore, the lever 26 that is connected to the case-side shutter 28 via the gear is provided in the toner container 6. As a result, the discharge port 35 of the case body 22 can easily be opened and closed according to an operation of the lever 26. On the other hand, the lever-side gear 64 of the lever 26 engages with the shutter-side gear 76 of the case-side shutter 28. As a result, due to errors in component sizes and assembling, an engagement position between the lever-side gear 64 and the shutter-side gear 76 may vary and a reaction force in directions separating from each other (refer to an arrow A in FIG. 5) may be generated at a position where the lever-side gear 64 engages with the shutter-side gear 76 during rotation of the lever 26 and the case-side shutter 28. This may make rotation of the lever 26 and the case-side shutter 28 non-smooth, and cause tooth skipping of the lever-side gear 64 and the shutter-side gear 76. However, in the present embodiment, the projection portion 46 is guided by the guide hole 72 during the rotation of the case-side shutter 28, as described above. As a result, the above described defects can be certainly prevented.

Second Embodiment

Figure 14A:
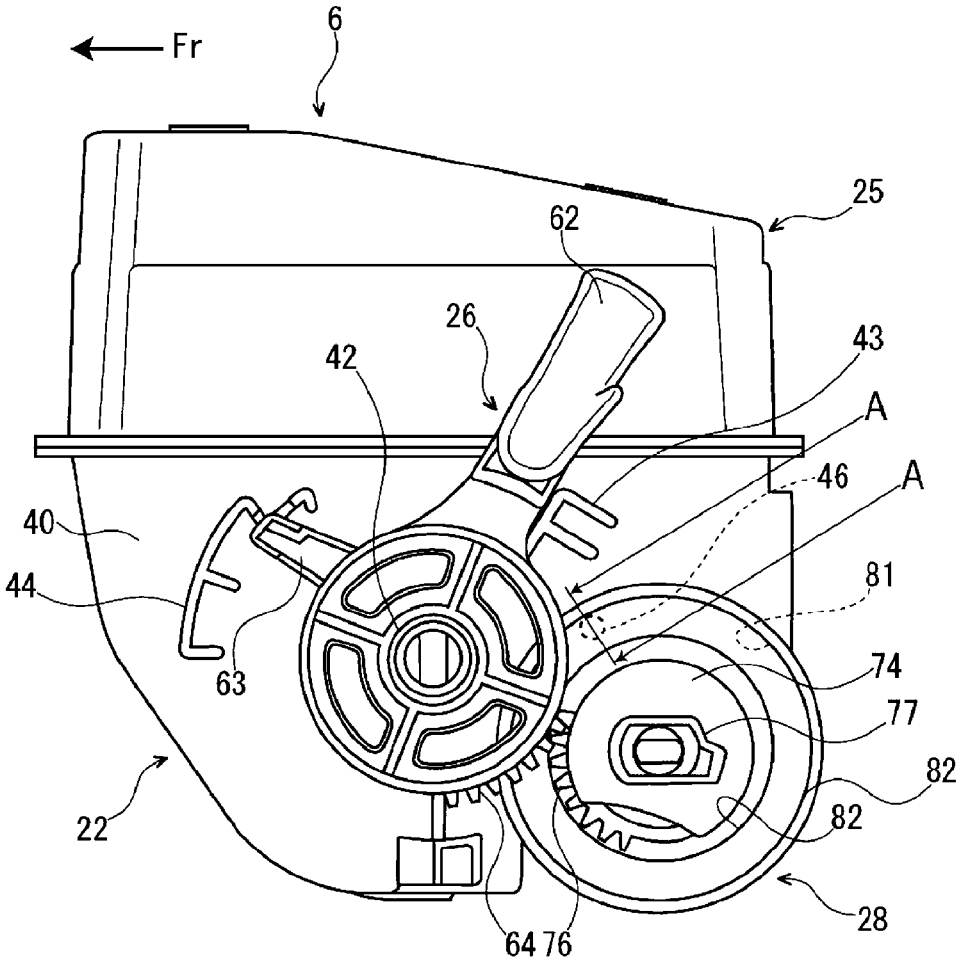
FIG. 14A is a right side view showing a state in which the grip portion of the lever is tilted rearward in the printer according to a second embodiment of the present invention.
Figure 14B:
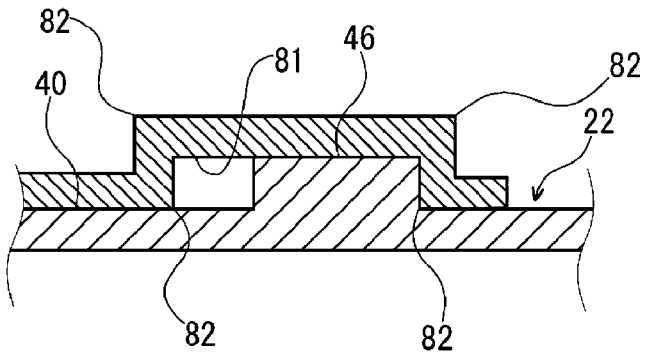
FIG. 14B is a cross-sectional view taken along a line A-A of FIG. 14A of the printer according to the second embodiment of the present invention.
Figure 15:
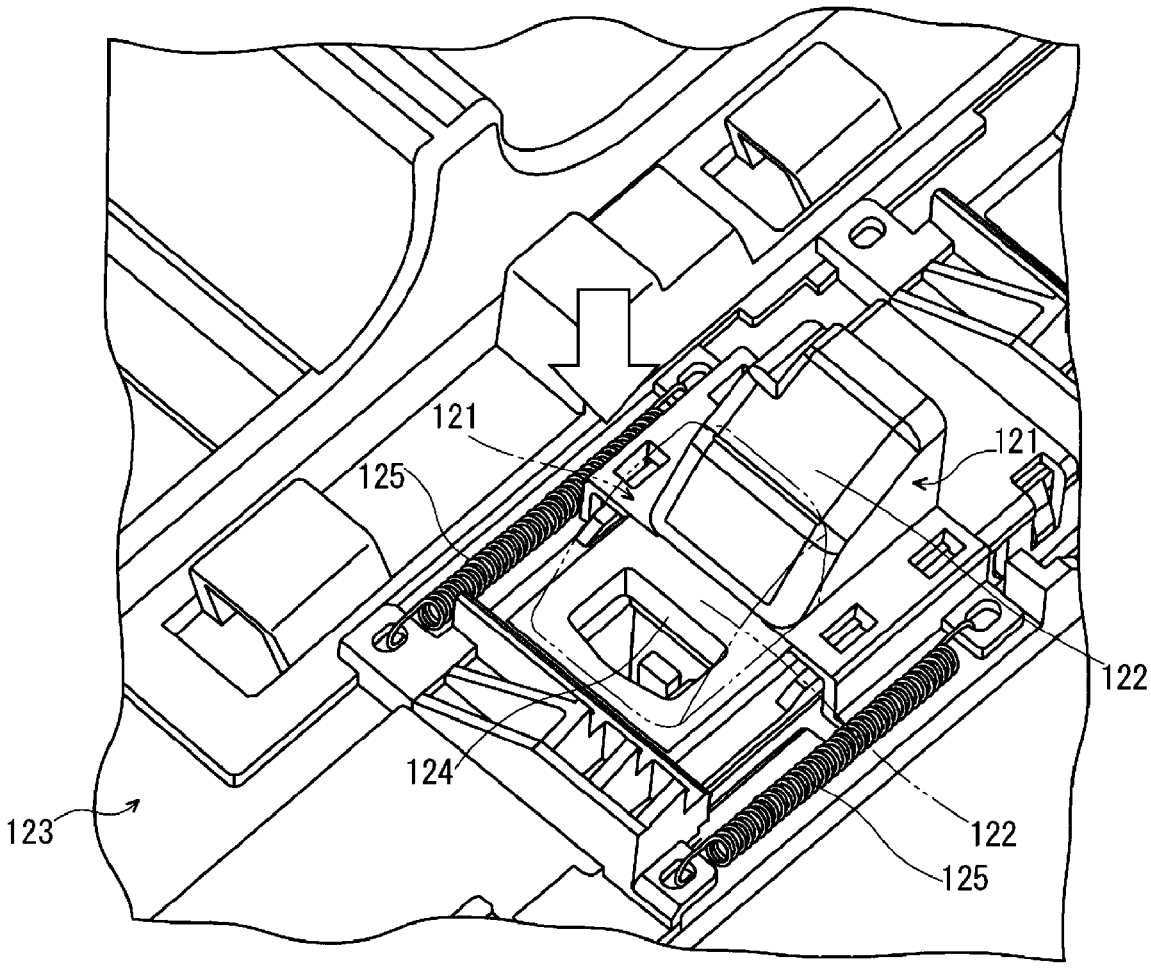
FIG. 15 is a perspective view illustrating a configurational example of a conventional developer-side shutter.

Next, a second embodiment of the present invention will be described with reference to FIGS. 14A and 14B. FIG. 14A is a right side view showing a state in which the grip portion of the lever is tilted rearward in the printer according to the second embodiment of the present invention. FIG. 14B is a cross-sectional view taken along the line A-A in FIG. 14A. Configurations except for the case-side shutter 28 are the same as those of the first embodiment and therefore description thereof is omitted.

In the first embodiment of the present invention, the arc-shaped guide hole 72 is provided on the case-side shutter 28. On the contrary, in the second embodiment, a circular groove (hereinafter referred to as a "guide groove 81") as the guide portion is provided on the case-side shutter 28 as shown in FIGS. 14A and 14B. The projection portion 46 engages with the guide groove 81. The projection portion 46 is provided on the right end wall 40 of the case body 22. In other words, the guide groove 81 is provided not only in directions in which the reaction force is applied to the lever-side gear 64 and the shutter-side gear 76 during rotation of the lever 26 and the case-side shutter 28, but in an entire periphery of the case-side shutter 28.

By employing such a configuration, the case-side shutter 28 can be reinforced compared to a case in which the guide hole (refer to the first embodiment) is formed on the case-side shutter 28. Especially, in the present embodiment, four circular folded portions 82 are formed on the case-side shutter 28 according to formation of the guide groove 81. As a result, the case-side shutter 28 can further be reinforced.

In the present embodiment, a configuration in which the lever 26 and the case-side shutter 28 are formed as separate components. However, in other embodiments, the lever 26 and the case-side shutter 28 can be integrally formed.

In the present embodiment, both the case-side shutter 28 and the developer-side shutter 98 are configured as rotational shutters. However, in other embodiments, any one of the case-side shutter 28 and the developer-side shutter 98 can be configured as a linearly slidable shutter, or both of the case-side shutter 28 and the developer-side shutter 98 can be configured as linearly slidable shutters. It should be noted that, as used herein, "displacement" indicates both a case in which a phase of a shutter is changed due to rotation of the shutter (refer to the case-side shutter 28), and a case in which a position of a shutter is changed due to rotation or linear sliding of the shutter (refer to the developer-side shutter 98).

In the present embodiment, a configuration in which the case-side shutter 28 rotates as the lever 26 is manually rotated has been described. However, in other embodiments, the case-side shutter 28 can also be configured to rotate automatically as the toner container 6 is mounted to the printer main body 2.

In the present embodiment, a case in which the guide hole 72 is provided on the case-side shutter 28 and the projection portion 46 is provided on the case body 22 has been described. However, in other embodiments, contrarily, the projection portion 46 can be provided on the case-side shutter 28 and the guide portion such as the guide hole 72 can be provided on the case body 22.

In the present embodiment, the configuration of the present invention has been applied to the toner container 6. However, in other embodiments, the configuration of the present invention can also be applied to a toner case (a so-called "intermediate hopper") provided between the toner container 6 and the developer 12.

In the present embodiment, a case in which the configuration of the present invention is applied to the printer 1 has been described. However, in other embodiments, the configuration of the present invention can also be applied to image forming apparatuses other than the printer 1, such as a copy machine, facsimile machine, multifunction peripheral and the like.

What is claimed is:

1. An image forming apparatus comprising:

a toner case including a case body provided with a discharge port for discharging toner, and a case-side shutter for opening and closing the discharge port; and a developer to which the toner case is detachably mounted, the developer including a developer body provided with a replenishing port for accepting the toner discharged from the discharge port and a developer-side shutter for opening and closing the replenishing port, wherein the case body is provided with a cylindrical discharge duct with the discharge port, wherein the case-side shutter is in a cylindrical shape and attached rotatably to an outer periphery of the discharge duct, wherein a pressing projection for pressing the developer-side shutter along with rotation of the case-side shutter is provided to an outer periphery of the case-side shutter, and wherein, when the toner case has been mounted to the developer and the case-side shutter is displaced from a position where the discharge port is closed to a position where the discharge port is open, the case-side shutter pushes the developer-side shutter and the developer-side shutter is displaced from a position where the replenishing port is closed to a position where the replenishing port is open.

2. The image forming apparatus according to claim 1, wherein: the case body rotatably supports a lever that is connected to the case-side shutter; and the case-side shutter rotates according to an operation of the lever.

3. A toner case that includes a case body provided with a discharge port for discharging toner, and a case-side shutter for opening and closing the discharge port, the toner case being detachably mounted to a developer, wherein the case body is provided with a cylindrical discharge duct with the discharge port, wherein the case-side shutter is in a cylindrical shape and attached rotatably to an outer periphery of the discharge duct, wherein a pressing projection for pressing a developer-side shutter along with rotation of the case-side shutter is provided to an outer periphery of the case-side shutter, and wherein, when the toner case has been mounted to the developer and the case-side shutter is displaced from a position where the discharge port is closed to a position where the discharge port is open, the case-side shutter pushes the developer-side shutter and the developer-side shutter is displaced from a position where a replenishing port provided in the developer is closed to a position where the replenishing port is open.

4. A toner case that includes a case body provided with a discharge port for discharging toner, and a case-side shutter for opening and closing the discharge port, wherein a guide portion is provided in the case-side shutter along a rotational direction of the case-side shutter, the guide portion being configured to be one of an arc-like hole and a circular groove; and a projection portion that is engageable with the guide portion is provided in the case body.

5. An image forming apparatus comprising the toner case according to claim 4.

6. A toner case that includes a case body provided with a discharge port for discharging toner, and a case-side shutter for opening and closing the discharge port, wherein a guide portion is provided in one of the case body and the case-side shutter, along a rotational direction of the case-side shutter, wherein a projection portion that is engageable with the guide portion is provided in the other one of the case body and the case-side shutter, and wherein the case body rotatably supports a lever that is connected to the case-side shutter via a gear and the case-side shutter rotates according to an operation of the lever.

7. An image forming apparatus comprising the toner case according to claim 6.

* * * * *